US007333029B2

(12) United States Patent
Hammett

(10) Patent No.: US 7,333,029 B2
(45) Date of Patent: Feb. 19, 2008

(54) AUTOMATED TRAFFIC CONTROL SYSTEM

(76) Inventor: Juanita I. Hammett, 13898 Highway TT, Festus, MO (US) 63028

( * ) Notice: Subject to any disclaimer, the term of this patent is extended or adjusted under 35 U.S.C. 154(b) by 164 days.

(21) Appl. No.: 11/358,466

(22) Filed: Feb. 21, 2006

(65) Prior Publication Data

US 2006/0197683 A1 Sep. 7, 2006

Related U.S. Application Data

(60) Provisional application No. 60/655,187, filed on Feb. 22, 2005.

(51) Int. Cl.
*G08G 1/095* (2006.01)

(52) U.S. Cl. ..... 340/908; 340/908.1; 340/539.1; 340/907; 116/63 R

(58) Field of Classification Search ..... 340/908, 340/908.1, 539.1, 907, 925, 926, 905, 321, 340/691.6, 691.3, 693.5; 40/610, 606; 348/149; 116/63 R, 63 P
See application file for complete search history.

(56) References Cited

U.S. PATENT DOCUMENTS

| | | | | |
|---|---|---|---|---|
| 2,829,362 A | | 4/1958 | Terrill | |
| 3,729,706 A | | 4/1973 | Hein | |
| 3,995,250 A | | 11/1976 | Ferree | |
| 4,032,883 A | | 6/1977 | Gibson | |
| 4,992,788 A | | 2/1991 | Arndt | |
| 5,252,969 A | | 10/1993 | Kishi | |
| 5,590,217 A | * | 12/1996 | Toyama | 382/104 |
| 5,986,576 A | | 11/1999 | Armstrong | |
| 6,052,067 A | * | 4/2000 | Nuxoll | 340/908 |
| 6,104,313 A | | 8/2000 | Boyd | |
| 6,118,388 A | | 9/2000 | Morrison | |
| 6,150,957 A | * | 11/2000 | Henz et al. | 340/908 |
| D457,827 S | | 5/2002 | Williams | |
| 6,888,474 B2 | * | 5/2005 | Sharp et al. | 340/907 |

* cited by examiner

*Primary Examiner*—Anh V. La
(74) *Attorney, Agent, or Firm*—Charles McCloskey

(57) ABSTRACT

The invention emulates the actions and decisions of flagmen to control and to expedite traffic along a single lane past construction. The invention has two portable traffic signal light units with arms. One unit has a computer that controls the system, three video cameras, and two way radio communication. The other unit has three video cameras and radio communication to the unit. A remote control is also provided for starting and stopping the system along with a manual override of the system. A coding feature restricts starting, and stopping the system to users of the remote control. The system also protects itself against vandalism and functions during periods of obscured vision.

10 Claims, 5 Drawing Sheets

AUTOMATED TRAFFIC CONTROL SYSTEM

CROSS REFERENCE TO RELATED APPLICATION

This non-provisional patent application claims priority to the provisional patent application 60/655,187 which was filed on Feb. 22, 2005 and is commonly owned by the same inventors.

BACKGROUND OF THE INVENTION

The automated traffic control system relates generally to automotive traffic signaling, and more specifically to optical driven signals for vehicles proximate to road construction.

The present invention seeks to reduce the costs of flagmen and injuries to them near road construction or other hazards. Roads undergo construction and maintenance, and occasionally endure a vehicular accident. Motorists still use roads during construction and after some accidents, often sharing a road with oncoming traffic under control of one or more flagmen. The flagmen stop traffic in one direction and allow other traffic to proceed. Flagmen at each end of a construction site coordinate changes in the direction of traffic at time intervals suitable to the volume of traffic.

DESCRIPTION OF THE PRIOR ART

Traffic lights and controls have taken many forms over the years. Prior art controls often have two signals, placed at the entrance and exit to road construction, and a device remotely controlled by an operator. The operator replaces the flagmen and works away from the roadway, out of danger. Use of television cameras allows the operator to view traffic outside of line of sight. The cameras provide a view of traffic to an operator who then controls the traffic. Some prior art devices also use timing circuits that switch lights between red and green over a time interval that allows traffic to clear the road construction. However, the remote control devices still require one operator and the timing circuits move traffic inefficiently.

The prior art has avoided replacing the functions performed by flagmen in controlling traffic. Flagmen communicate by line of sight, if possible, along a construction area or use portable radios if out of sight of each other. Each flagman gauges the volume of traffic at their respective posts. The flagmen then communicate and decide upon how many vehicles from which direction to allow past the construction area. The flagman admitting traffic tells the other flagman the number of expected vehicles to exit past the other flagman. The flagman then counts vehicles as they exit the construction area. When all vehicles have exited, the flagman at the exit then admits vehicles in the other direction and the flagmen reverser roles. The presence of flagmen allows adjustment in traffic flow around the construction area and deters errant drivers that may ignore a temporary unmanned traffic light.

Regarding traffic moving inefficiently, timers on signals at road construction have a set pattern for lights controlling traffic but the pattern does not adjust for variations in traffic volume. For example, a road construction site has an entrance and an exit with lights controlled by simple timers. A light at the entrance turns green for a set time interval to admit traffic whether traffic has accumulated or not. The light at the exit remains red for a similar set time interval sufficient for any traffic to clear the road construction whether actually admitted to pass the construction or not.

Then the lights reverse to admit traffic through the former exit and to release traffic from the former entrance. Traffic may accumulate at either entrance or exit while the simple timer cycles, as if the traffic approaches each end of the construction evenly, causing unnecessary delay and potentially lengthy backups.

The patent to Terrill, U.S. Pat. No. 2,829,362, shows a pair of lights controlled with a radio transmitter as a system to control traffic. Like the present invention, the patented system has two separate lights controlled by a central transmitter and uses radio communication. However, this patent lacks sensors to detect vehicles and lacks gate arms.

The patent to Hein, U.S. Pat. No. 3,729,706, shows a traffic control with television monitoring. Akin to the present invention, this patent has traffic lights connected by wire to a central console and traffic sensors of the pressure or electrical type.

In contrast, this patent has wheeled traffic lights with tilt sensors, television cameras, and a person required to operate the console.

The patent to Ferree, U.S. Pat. No. 3,995,250, shows a portable traffic signal upon a mast. This patent has a control box and a support stand for the traffic light. The support stand collapses for compact storage. On the other hand, this patent has a high overhead mast, traffic lights generally over the center of a traffic lane, no sensors, and a new traffic light lens.

The patent to Gibson, U.S. Pat. No. 4,032,883 shows a portable traffic signal contained in a cabinet with battery power. This patent has a portable light and a timing mechanism to regulate display of the light. Differing from the present invention, this patent has a telescoping support beneath the light, no sensors, fold down legs beneath the cabinet, and an internal battery.

The patent to Arndt U.S. Pat. No. 4,992,788, shows a trailer mounted traffic control system. Similar to the present invention, this patent has lights upon arms and the arms move with the trailer. Different from the present invention, this patent has a trailer with swing out arms having lights, and no control box and no radio communications.

The patent to Kishi, U.S. Pat. No. 5,252,969, shows a two light temporary traffic signal system. Akin to the present invention, this patent has two lights and uses radio communications between them. Unlike the present invention, this patent has self correcting timers, lacks sensors, and prefers no wire communications.

Infringement of this patent is not likely as the present invention has sensors and a central control box.

The patent to Armstrong, U.S. Pat. No. 5,986,576, shows a remote controlled portable traffic light located at the center of an intersection. This patent has radio communication between the control and the light and an anti-theft feature. Unlike the present invention, the patent has four faced light emitting diodes, a center intersection location, warning lights away from the central light, and no sensors.

The patent to Boyd, U.S. Pat. No. 6,104,313, illustrates an automatic flagman. As the present invention does, this patent seeks to solve the problem of labor costs and uses radio to remotely control the turning of the sign. However, this patent has a two sided flat sign with lights, mechanical gears to turn the sign, and no red yellow green traffic lighting.

Then the patent to Morrison et al., U.S. Pat. No. 6,118,388, shows a four faced traffic light upon a pole on a wheeled cart. Similar to the present invention, this patent has a remote control for the light and electronics for cycling of the lights. In contrast to the present invention, this patent has a single light, no sensors, a hydraulic telescoping pole, and a wheeled cart.

The patent to Williams et al., U.S. Pat. No. D457,827, illustrates the design of a portable traffic light. Like the present invention, this patent has a pole on a light stand, a round flat base, and an appearance similar to the light stand in the drawings of the present invention. In contrast to the present invention, this patent has no sensors and no additional parts beyond the traffic light.

The present invention emulates the actions and decision making of flagmen and overcomes the difficulties and delays inherent in timers. The present invention functions as an nearly autonomous signal that anticipates oncoming traffic and tailor the lights to optimize traffic flow similar to flagmen. Augmenting the present invention with an arm would deter errant drivers from jumping the light. As the present invention expedites traffic past road construction, drivers experience less frustration and more compliance with the lights operated efficiently.

SUMMARY OF THE INVENTION

Generally, the present invention provides a system that emulates the actions and decisions of flagmen to control and to expedite traffic along a single lane past road construction or other obstacle. The present invention has two portable traffic signal light units with lift gates. One unit, designated the master unit, has a computer that controls the system as well as three video cameras and two way radio communication. The other unit, designated the slave unit, has three cameras and radio communication to the master unit. A hand held remote control is also provided for starting and stopping the system along with a manual override of the system if needed. The system has a coding feature maintained by the remote control so that only the remote control can start and stop the system. The coding feature deters theft and interference by other radio sources. The system also protects itself against vandalism and functions during periods of obscured vision such as inclement weather and darkness.

There has thus been outlined, rather broadly, the more important features of the invention in order that the detailed description thereof that follows may be better understood and that the present contribution to the art may be better appreciated.

The invention may also include master and slave units that gauge traffic volume at both the entrance and exit of a construction area and stop traffic in an alternating manner at the entrance and exit. The units count the vehicles entering a construction area, relay the vehicle count to the unit at the exit to admit vehicles at the exit and stop traffic when the correct number of vehicles depart the construction area. The units then reverse roles and count vehicles admitted at the exit and check the number of vehicles departing at the entrance. The units alternate in this manner as traffic volume indicates, much like flagmen.

The present invention also accounts for variations in traffic flow. During active work, vehicles entering a construction area may remain in the area for some time. Delivery trucks for concrete and other materials and contractor vehicles may enter the construction area and remain for minutes or hours or longer. The present invention adjusts the vehicle counts to vehicles that remain in the construction area longer than the time interval needed to pass the construction area. Also, construction equipment may enter the traffic flow from elsewhere along a road and the present invention accounts for this addition. The present invention also accounts for vehicles that may start in the traffic flow but depart the traffic flow into the construction area. Technology to count, monitor, and control traffic has been adopted by the present invention. The present invention incorporates machine vision, high speed computing, high capacity computer memory, fuzzy logic in the software, video cameras, and diode lighting among other things.

During inclement weather or darkness, the present invention uses lighting or strobe lights to illuminate vehicles, more particularly license plates thereon. In the event of compromised vision, such as optical equipment failure, or a software crash, the present invention defaults to preprogrammed cycles for lights to control traffic flow into and out of a construction area.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved automated traffic control system.

Another object is to provide an automated traffic control system that can be easily and efficiently manufactured and marketed to the consuming businesses and government entities.

Another object is to provide an automated traffic control system that counts vehicles passing a point.

Another object is to provide an automated traffic control system that identifies vehicles passing a point.

Another object is to provide an automated traffic control system that adjusts the count of vehicles for other vehicles that enter and depart a traffic flow from within a construction area.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1A:
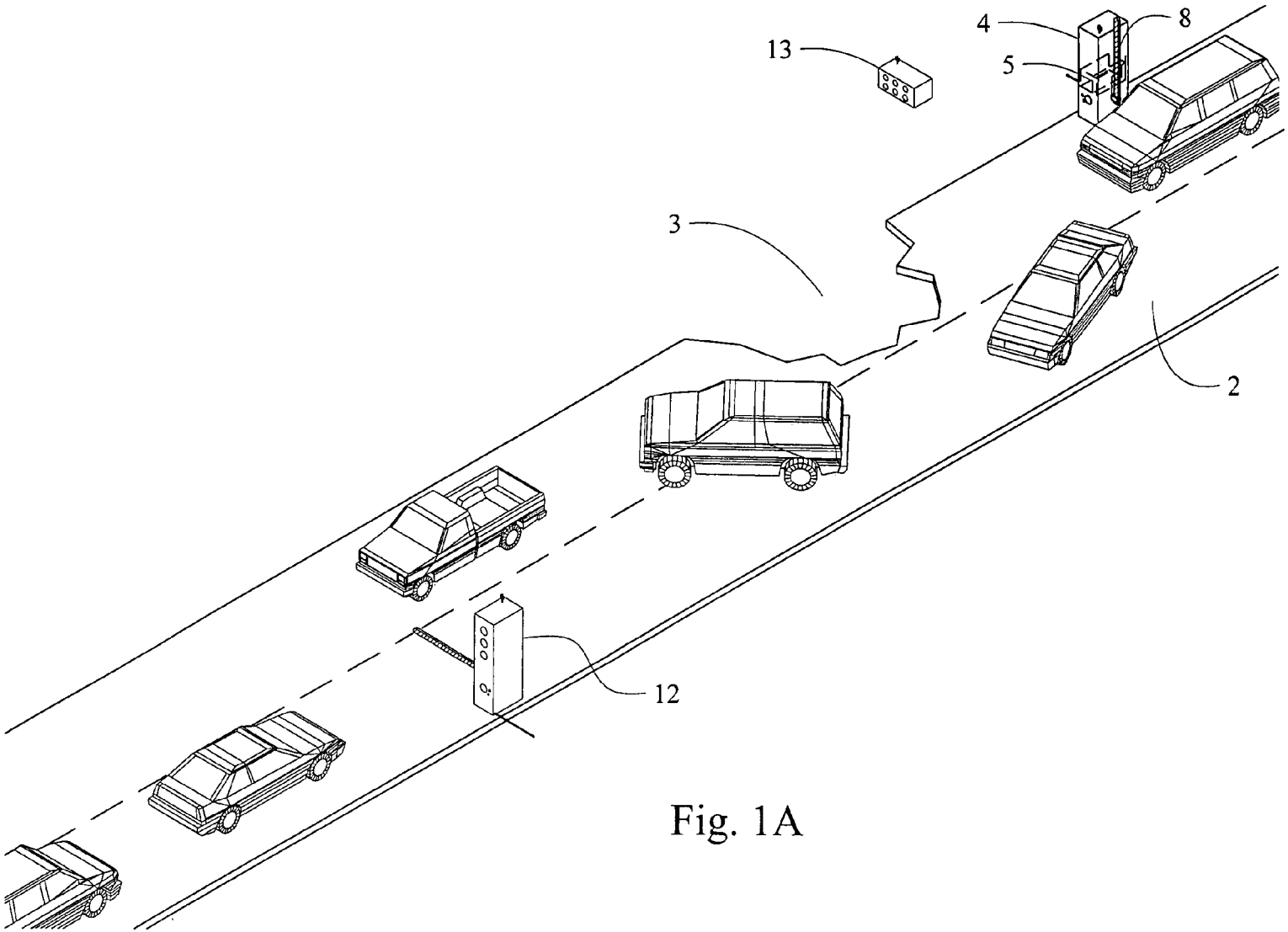
FIG. 1A shows an isometric view of traffic and the preferred embodiment of the present invention in use.
Figure 1B:
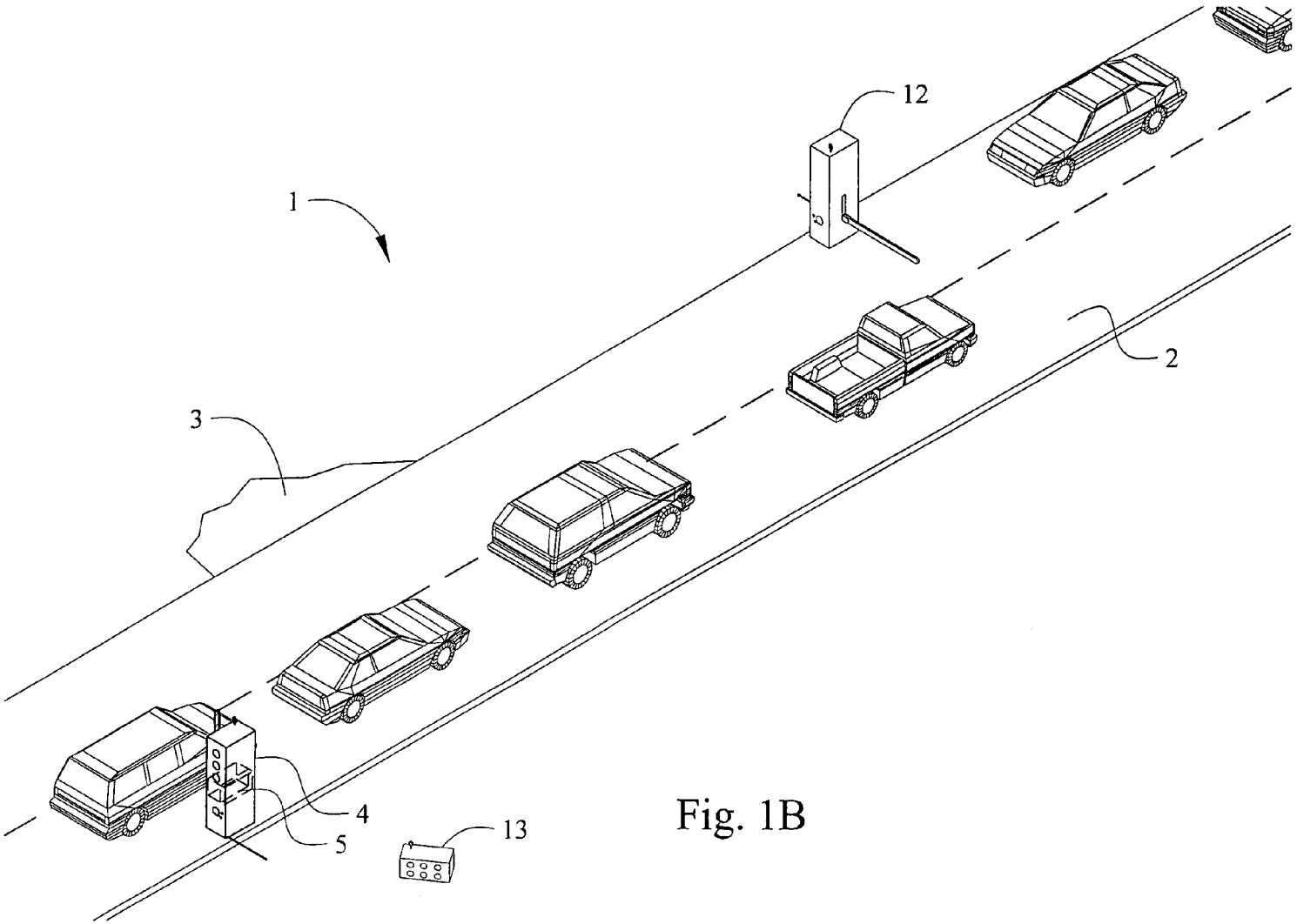
FIG. 1B shows another isometric view of traffic regulated by the present invention in use.

The present art overcomes the prior art limitations by providing an automated traffic control system 1 that counts and identifies passing vehicles. Vehicles encounter obstacles 3 such as construction upon roads around the world. In many cases, one lane 2 of traffic is allowed to pass the construction while traffic from the opposite direction waits. FIGS. 1A, 1B show traffic passing construction under the control of the present invention 1. The present invention 1 has a master unit 4, a slave unit 12, and a remote control 13. The master unit 4 differs from the slave unit 12 by having a computer 5 contained within. The handheld remote control 13 communicates with the master unit 4 to start, to stop, and to adjust the present invention 1. Each unit has an arm 8 to regulate the entry of traffic into a lane 2 past construction and the familiar red, yellow & green lights 7 to advise traffic passing the gate like arm 8 when the arm 8 will drop.

Figure 2:
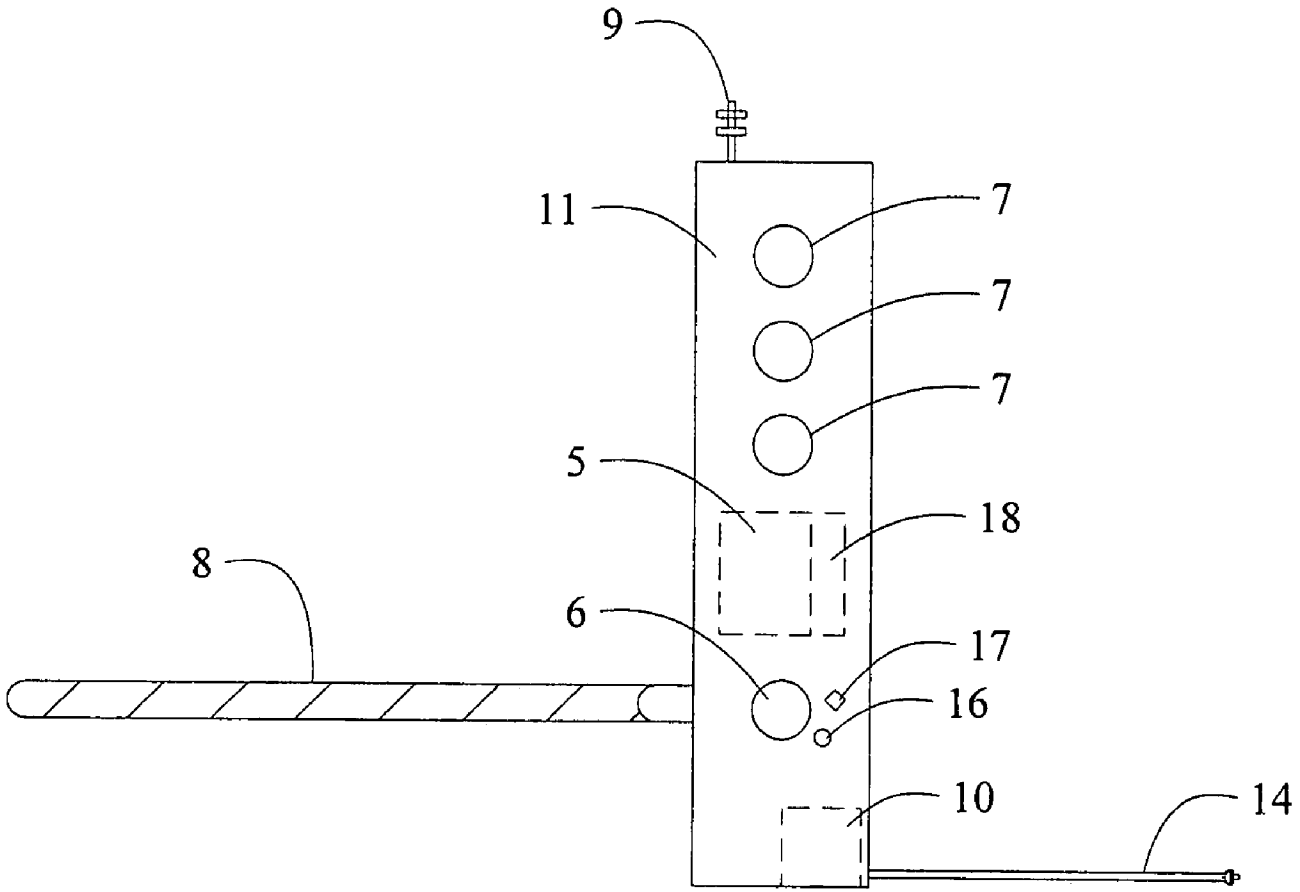
FIG. 2 shows a front view of a unit of the present invention.

FIG. 2 shows a typical unit of the present invention 1. The master unit 4 and the slave unit 12 differ by the presence of a computer 5 that operates the invention 1. The master unit 4 has the computer 5 and the following description applies to both units but for the computer 5. A unit has a housing 11 of a generally upright shape with a front, rear, and side. The front faces toward traffic, the rear faces opposite the front, and the side faces toward the travel lane 2 of the traffic. FIG. 2 describes the front face of a unit. The front face has typical lights 7 in a red, yellow & green pattern to advise traffic about passing into the travel lane 2. A green light 7 indicates passage is allowed into the travel lane 2 and that the arm 8 is up. A yellow light 7 indicates entrance of traffic into the travel lane 2 will cease momentarily as the arm 8 descends. And the red light 7 indicates passage is denied into the travel lane 2 and that the arm 8 is down. In the preferred embodiment, the lights 7 are arranged vertically with red on top. Beneath the lights 7, the front face has a camera 6. The camera 6 faces forward to capture an image of an approaching vehicle particularly the license plate. Proximate to the camera 6, lighting 17 illuminates vehicles during periods of poor visibility. The lighting 17 takes the form of diodes, electric flash, or a strobe. The unit also has a microphone 16, here shown near the lighting 17. The microphone 16 detects the sirens of approaching emergency vehicles. Upon the side, an arm 8 extends into the travel lane 2. The arm 8 has a mechanism to raise and to lower the arm 8 in coordination with the three lights 7. The unit operates electrically and receives power by wire from an external source and also has an onboard battery 10 for remote operations or in the event of a power failure by wire. An antenna 9 upon the unit, here shown at the top, allows the computer 5 to coordinate the master unit 4 and slave unit 12 in their signaling and the observation of vehicles by the cameras 6. Within the master unit 4, a computer 5 analyzes the images from the cameras 6 and coordinates the lights 7 and arms 8 of both units to control traffic flow. In the event of a computer 5 crash or other malfunction, the unit includes a preprogrammed timer mechanism 18 to operate the lights 7 and arms 8 as well.

Figure 3:
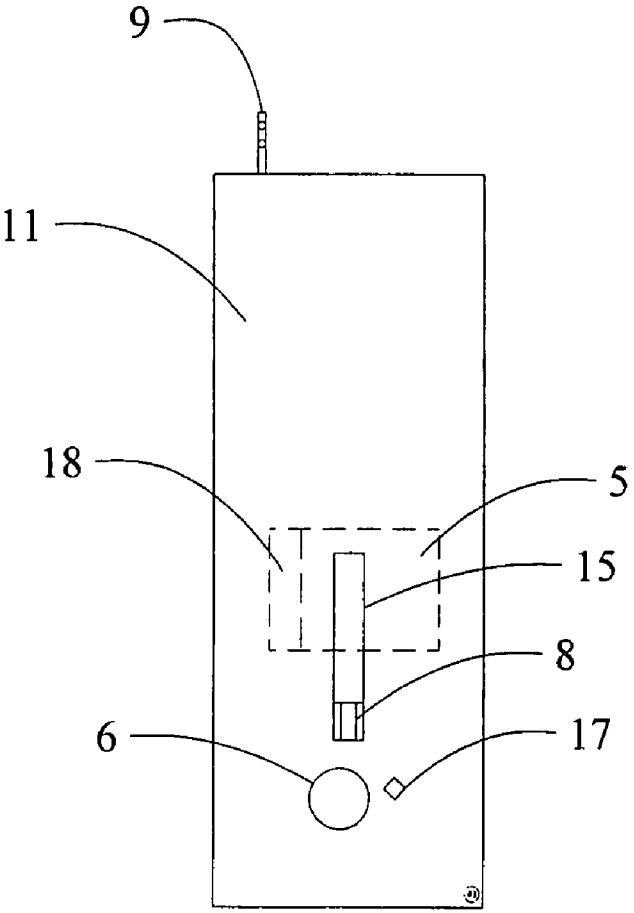
FIG. 3 describes a side view of a unit of the present invention.

Turning to FIG. 3, the present invention 1 has a side where the arm 8 extends outward. The arm 8 extends from a slot 15 in the unit that permits the arm 8 to rise and to lower. Beneath the arm 8 and at a similar elevation to the front camera 6, a side camera 6 collects images of vehicles as they pass the unit. A lighting 17 proximate to the side camera 6 illuminates vehicles as needed.

Figure 4:
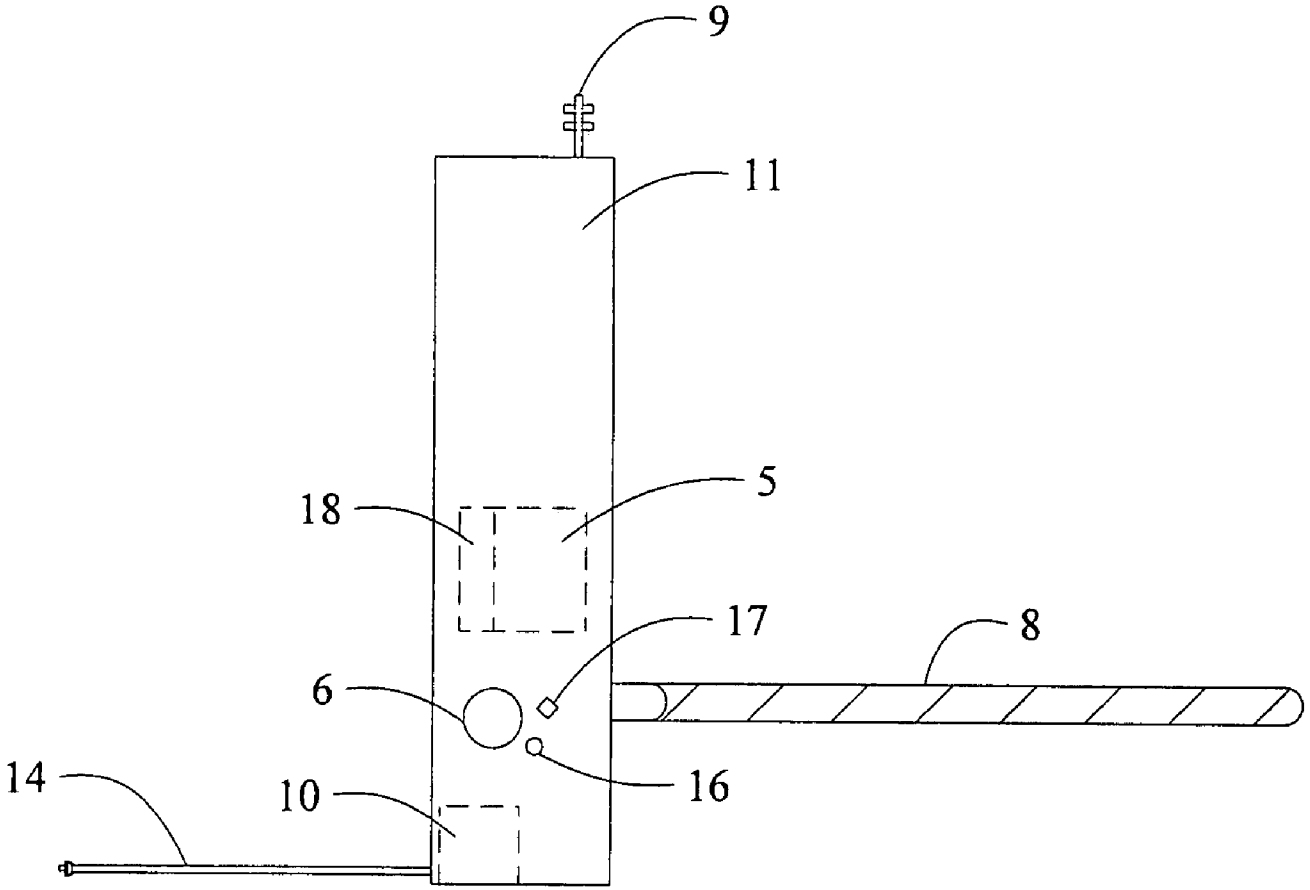
FIG. 4 describes a rear view of a unit of the present invention.

Opposite FIG. 2, FIG. 4 describes the rear of a unit. The rear has a rear camera 6 at the same elevation as the other cameras 6 in the unit. The rear camera 6 also has a lighting 17 for illumination and a microphone 16. In the slave unit 12, the cameras 6 relay images via the antenna 9 to the computer 5 and the computer 5 transmits commands relating to the lights 7 and the arm 8 of the slave unit 12. In the master unit 4, the cameras 6 relay images directly to the computer 5 and the computer 5 then commands operation of the lights 7 and arm 8 in the master unit 4.

In use, the present invention 1 is deployed along a stretch of road being repaved, with one lane 2 open for traffic as in FIGS. 1A, 1B. The master unit 4 is at one end of the construction and the slave unit 12 is at the opposite end. Both units are positioned with the lights 7 facing traffic and the arms 8 extending into the travel lane 2. When initially powered, both units illuminate the red light 7 and lower the arm 8 to block traffic. A worker then presses the start button upon the remote control 13 to activate the present invention 1. The present invention 1 now has the computer 5, cameras 6, lighting 17, and microphones 16 operating.

Each unit has the front camera 6 viewing traffic approaching the unit, the rear camera 6 viewing traffic departing the unit, and the side camera 6 viewing each vehicle as it passes the unit. As a vehicle approaches a unit, the front camera 6 transmits images to the computer 5. As the vehicle image increases, the computer 5 recognizes the vehicle as approaching the unit. The computer 5 then counts the vehicles approaching a unit and a machine vision program within the computer 5 records individual characteristics of each vehicle. In the preferred embodiment, the machine vision records license plates including vanity and affinity plates. In an alternate embodiment, such as in states where a front license plate is not required, the machine vision records visual characteristics of each vehicle such as color and shape. The rear camera 6 in the alternate embodiment looks for license plate numbers once the vehicles pass the unit going into the construction area. In the preferred embodiment, the side camera 6 transmits to the computer 5 images of vehicles from a different perspective as they pass the unit.

The computer 5 contains a traffic management algorithm. The algorithm regulates when and from which direction to admit traffic into the construction zone 3. Generally, when one end of construction zone 3 has more traffic than the other, the algorithm allows the computer 5 to admit traffic from the higher volume end. The algorithm then alternates the directions of traffic to admit and checks the traffic volume from time to time in case traffic accumulates more at one end than another. In operation while using the algorithm and when the computer 5 decides that one unit has accumulated enough vehicles, the green light 7 illuminates and the arm 8 raise on that unit to admit traffic. Upon the other unit the red light 7 illuminates and the arm 8 remains down to prevent admission of traffic. After a calculated number of vehicles pass the unit with the green light 7, the yellow light 7 illuminates and the arm 8 lowers. When the arm 8 returns to a horizontal position, the red light 7 illuminates upon the unit admitting traffic and the opposite unit. At this time, the traffic admitted into the construction zone 3 clears the zone 3.

While the traffic clears the construction, the computer 5 begins to look for the vehicles via the cameras 6 on the other unit. As the traffic passes the other unit, the rear and side cameras 6 identify the vehicle for comparison with the stored images. When the computer 5 matches a stored image of a vehicle with an image of the vehicle departing the other unit, the computer 5 reduces the total vehicle count. If a vehicle exits from the travel lane 2 and enters the construction, the computer 5 via the cameras 6 will note the absence of that vehicle and reduce the count of vehicles supposed to pass the other unit. If the last vehicle identified by the unit exits from the travel lane 2, the computer 5 will transmit an alarm 8 signal to the remote control 13. Alerted by the alarm 8, an operator can investigate a missing vehicle and adjust the count of vehicles supposed to pass the other unit. If the operator ignores the alarm 8, the computer 5 delays for a time proportional to the length of the construction zone 3 and designates that vehicle as exiting the travel lane 2 within the construction zone 3. When a previously counted vehicle—that has exited the travel lane 2 within the construction zone 3—returns to the travel lane 2, the computer 5, using stored images, will recognize and account for the vehicle as it passes the other unit and exits the construction zone 3.

More particularly in the preferred embodiment, the computer 5 can keep a permanent record of all vehicles or delete records of vehicles once they exit the construction zone 3. The computer 5 also signals the remote control 13 if certain types of vehicle approach, such as construction vehicles and equipment. Using the images, machine vision, and the decision algorithm, the computer 5 recognizes license plates and may be programmed to alert police if selected license plates are spotted. Following the decision algorithm, the computer 5 will continually monitor traffic volume at both the master unit 4 and the slave unit 12 and adjust the number of vehicles admitted into the construction zone 3. Also, the units have microphones 16 in communication with the computer 5. If an emergency siren is detected by the microphones 16, the computer 5 will expedite passage of the emergency vehicle. Particularly, the computer 5 will illuminate the red lights 7 on both units and raise the arm 8 on the unit closest to the emergency vehicle. After traffic passes that arm 8, the emergency vehicle then enters the travel lane 2 alone. Then the other unit raises its arm 8 to release the emergency vehicle from the travel lane 2.

The present invention 1 operates electrically, by utility service means 14, battery 10, generator, or solar. Powered by utility service 14, this system 1 can operate for long periods unattended such as for bridge deck repairs. The present invention 1 also operates through nights and weekends in contrast to flagmen.

From the aforementioned description, an automated traffic control system has been described. The system is uniquely capable of viewing and counting traffic to adjust signal lights thus regulating traffic in a single lane passing a construction zone or other obstacle. The automated traffic control system and its various components may be manufactured from many materials including but not limited to steel, aluminum, polymers, polycarbonate, high density polyethylene HDPE, polyvinyl chloride PVC, nylon, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A system to regulate vehicular traffic moving in opposite directions upon a single lane of travel past an obstacle in an efficient manner without collisions, comprising:

a master unit having a computer, at least one camera, at least two colored lights, an arm, an antenna, a battery, and a housing;

a slave unit having at least one camera, at least two colored lights, an arm, an antenna in communication with said master unit, a battery, and a housing;

a remote control having an antenna in communication with said master unit and one or more batteries;

means to provide electrical power to said master unit and said slave unit; and, said computer using images from said cameras decides which of said arms to raise and which of said lights to illuminate.

2. The traffic regulating system of claim 1 further comprising:

said housing of said master unit having a slot proximate to said arm to permit elevation of said arm and at least one microphone; and, said housing of said slave unit having a slot proximate to said arm to permit elevation of said arm and at least one microphone.

3. The traffic regulating system of claim 1 wherein said cameras are one of video or digital.

4. The traffic regulating system of claim 3 further comprising: said cameras having lighting to illuminate vehicles.

5. The traffic regulating system of claim 4 wherein said lighting is one of diode, lighting, or strobe.

6. The traffic regulating system of claim 1 further comprising:

said computer having machine vision to identify license plates upon vehicles and vehicles;

said machine vision allowing said computer to count and to match images from said master unit and said slave unit, and said computer accounts for vehicles that enter and exit the travel lane; and, a timer mechanism that controls traffic when said computer fails.

7. The traffic regulating system of claim 6 further comprising:

said computer comparing images of vehicles against a list of vehicles sought by law enforcement.

8. A system to regulate vehicular traffic moving in opposite directions upon a single lane of travel, or travel lane, past an obstacle comprising:

a master unit having a computer;

a slave unit;

a remote control for said master unit wherein entering a first code starts said master unit, said computer, and said slave unit; entering a second code secures said master unit, said computer, and said slave unit; and entering a third code stops said master unit, said computer, and said slave unit; and, said computer selecting when traffic may enter the travel lane, determining which direction of traffic may first enter the travel lane, calculating the volume of traffic relative to said master unit and to said slave unit, adjusting the timing and direction of traffic in the travel lane based upon volume of traffic measured in real time, and, accounting for vehicles that exit and enter from within the travel lane.

9. The traffic regulating system of claim 8 further comprising:

said master unit and said slave unit having machine vision in cooperation with cameras and lighting to identify license plates upon vehicles and vehicles for comparison by said computer.

10. The traffic regulating system of claim 8 further comprising:

said master unit having at least two colored lights, at least one camera, a housing, an arm extending from said housing, an antenna, and a battery and said computer; and, said slave unit having at least two colored lights, at least one camera, a housing, an arm extending from said housing, an antenna, and a battery.

* * * * *